US007048260B2

(12) United States Patent
Gross et al.

(10) Patent No.: US 7,048,260 B2
(45) Date of Patent: May 23, 2006

(54) TURBOCHARGED AERATOR

(75) Inventors: Peter S. Gross, Plymouth, MN (US); Catalin Petrescu, Eden Prairie, MN (US)

(73) Assignee: Aeromix Systems, Incorporated, Golden Valley, MN (US)

( * ) Notice: Subject to any disclaimer, the term of this patent is extended or adjusted under 35 U.S.C. 154(b) by 0 days.

(21) Appl. No.: 10/844,593

(22) Filed: May 12, 2004

(65) Prior Publication Data

US 2005/0253288 A1 Nov. 17, 2005

(51) Int. Cl.
*B01F 3/04* (2006.01)

(52) U.S. Cl. ..... 261/28; 261/87; 261/91; 261/93

(58) Field of Classification Search ..... 261/28, 261/84, 87, 91, 93, DIG. 71, DIG. 75
See application file for complete search history.

(56) References Cited

U.S. PATENT DOCUMENTS 4,240,990 A 12/1980 Inhofer et al.
4,280,911 A 7/1981 Durda et al.
4,293,169 A 10/1981 Inhofer
4,308,221 A 12/1981 Durda
4,603,021 A * 7/1986 Urso ..... 261/30
4,741,870 A 5/1988 Gross
4,774,031 A 9/1988 Schurz
4,806,251 A 2/1989 Durda
4,844,843 A 7/1989 Rajendren
4,869,818 A * 9/1989 DiGregorio et al. ..... 210/194
4,882,099 A 11/1989 Durda et al.
4,954,295 A 9/1990 Durda
5,011,631 A 4/1991 Hwang
5,078,923 A 1/1992 Durda et al.
5,160,667 A 11/1992 Gross et al.
5,183,596 A 2/1993 Rajendren et al.
5,707,562 A 1/1998 Karliner
5,744,072 A 4/1998 Karliner
5,851,443 A 12/1998 Rajendren
5,988,600 A 11/1999 Vento
6,139,685 A * 10/2000 Saito ..... 162/55
6,394,423 B1 5/2002 Vento

* cited by examiner

*Primary Examiner*—Scott Bushey
(74) *Attorney, Agent, or Firm*—Kinney & Lange, P.A.

(57) ABSTRACT

The present invention is an aerator for inducing air flow below the surface of a liquid. The aerator includes a motor having a drive shaft. A propeller is operably connected to the drive shaft of the motor and a blower is operably connected to the motor. The aerator further includes an air flow path that has an inlet and an outlet, with the inlet connected to the blower and the outlet located near the propeller. The blower and the propeller rotate at different speeds.

22 Claims, 4 Drawing Sheets

TURBOCHARGED AERATOR

BACKGROUND OF THE INVENTION

The present invention relates to the treatment of liquids, including waste liquids. In particular, the present invention relates to an apparatus for mixing or aerating liquids.

Aeration devices used in the treatment of liquid, especially water, are known in the prior art. The aeration devices may be employed to encourage aerobic bacteria in treating wastewater or in treating bodies of water to make the water more potable or more suitable for food production. In addition, the aeration devices are commonly used for ice control purposes.

One type of aeration device known in the art includes a motor located above the liquid being treated and generally mounted to a support structure. A leg extends from the motor below the liquid surface and connects the motor to a submerged propeller. The leg includes a shaft coupled to the motor which drives the propeller and may include an outer housing that surrounds the shaft. An air inlet provided above the liquid surface allows the rotating propeller to draw air into the leg and supply a flow of air to the propeller. For this type of aeration, the quantity of air discharged into the liquid is dependent solely upon air flow created by the rotating propeller.

Airflow-assisted aerators, which augment the air flow created by the propeller, are known in the art. These aerators, however, do not include a blower and a propeller capable of being operated at different speeds while being powered by the same aerator motor, which results in sub-optimal aerator efficiency.

The present invention is an improved aerator that allows for the efficient supply of additional aeration capacity.

BRIEF SUMMARY OF THE INVENTION

The present invention is an aerator for inducing air flow below the surface of a liquid. The aerator includes a motor having a drive shaft. A propeller is operably connected to the drive shaft of the motor and a blower is operably connected to the motor. The aerator further includes an air flow path that has an inlet and an outlet, with the inlet connected to the blower and the outlet located near the propeller. The blower and the propeller rotate at different speeds.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principles of the invention. The figures may not be drawn to scale. Like reference numbers have been used throughout the figures to denote like parts.

DETAILED DESCRIPTION

Figure 1:
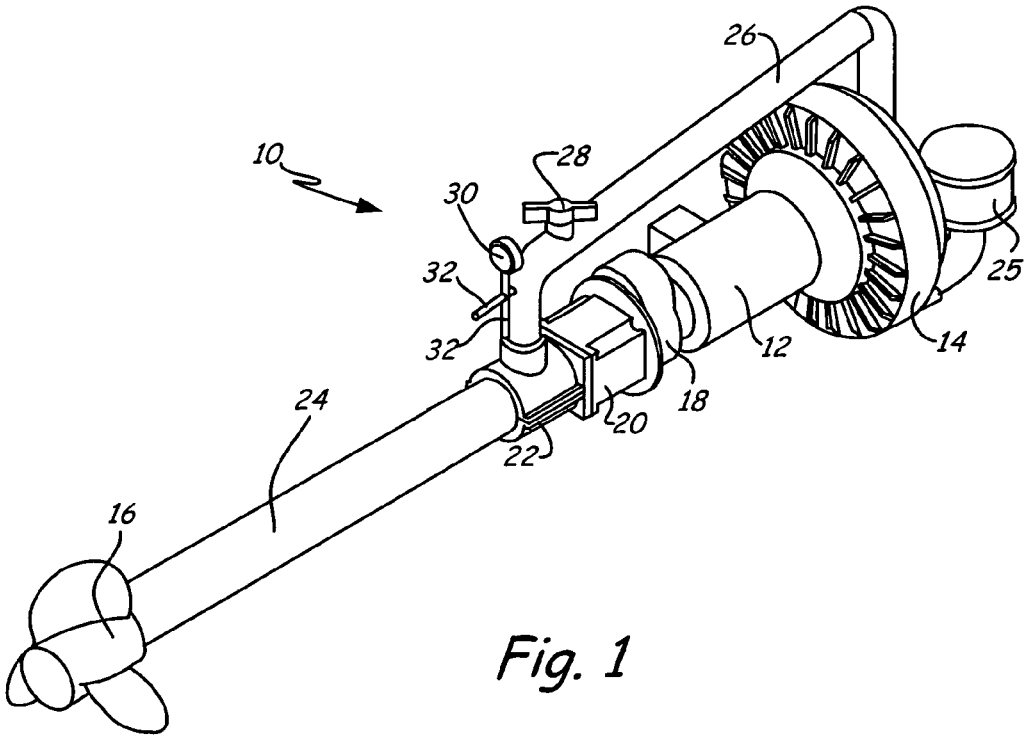
FIG. 1 is a side perspective view of an aerator.
Figure 2:
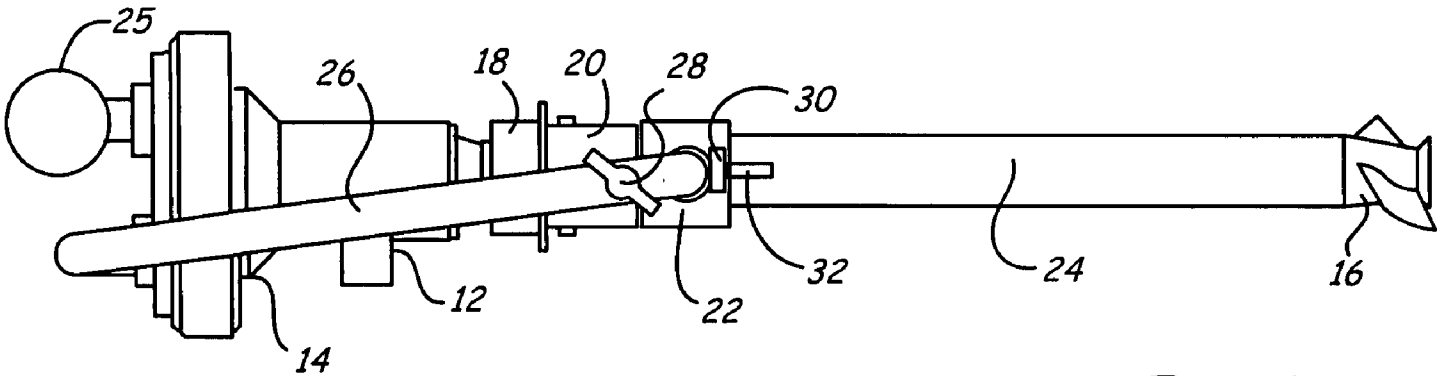
FIG. 2 is a top view of the aerator of FIG. 1.

FIGS. 1 and 2 show an aerator 10 of the present invention, with FIG. 1 showing a side perspective view of aerator 10 and FIG. 2 showing a top view of aerator 10. Aerator 10 includes a motor 12 that powers a blower 14 and a propeller 16 (represented in simplified form in FIG. 2). Motor 12 connects to a transmission 18, and may be an electric motor or any other type of motor known in the art. Transmission 18 is mounted to a motor mount 20 that connects to a draft tube 24, around which fits a pipe saddle 22.

Blower 14 has a blower intake 25 and is connected to a discharge pipe 26 that extends from blower 14 to pipe saddle 22, which is positioned over draft tube 24. Discharge pipe 26 and draft tube 24 define a flow path so that, when blower 14 is engaged, air is drawn into blower 14 through blower intake 25 and delivered to a hub (not shown) in propeller 16 that defines an airflow outlet for ejecting the air into the liquid. Blower 14 may provide air pressure and air flow well in excess of the amount of air of a traditional aspirating aerator, thereby enabling aerator 10 to force large volumes of air into the liquid. Blower 14 may be any suitable type of air supply means known in the art.

Draft tube 24, discharge pipe 26, and the hub in propeller 16 are preferably sized and shaped to maximize air flow. As shown in FIG. 1, discharge pipe 26 generally has an elongated U-shaped configuration. In other embodiments, discharge pipe 26 may have a different configuration. Draft tube 24 includes an air passage that, in some embodiments, has a cross sectional area along its length of at least about 4.2 square inches to minimize drag. Likewise, to maximize transfer of gas to the liquid, in some embodiments, the airflow outlet of propeller 16 has a cross-sectional area of at least about 5.95 square inches.

In some applications it may be desirable to introduce a gas other than air into the liquid to be treated. As such, the term "aeration," as used herein, is intended to encompass the introduction of any gas or combination of gasses, including air.

Discharge pipe 26 may include a throttling valve 28, an air discharge pressure gage 30, and air discharge pressure switches 32 (a high pressure discharge switch and a low pressure discharge switch) to regulate air flow from blower 14 to the air outlet of propeller 16. The inclusion of throttling valve 28 maximizes aerator performance and allows for adjustment of the airflow and the mixing and aeration ratio. Throttling valve 28 also allows air flow from blower 14 to propeller 16 so that propeller 16 can be used to mix the liquid without introducing air into the liquid from blower 14.

In some embodiments, a clutch (not shown) may be used to operably connect motor 12 and blower 14. When the clutch is engaged, motor 12 rotates both blower 14 and propeller 16. However, when the clutch is disengaged, motor 12 rotates propeller 16 without rotating blower 14, thereby allowing propeller 16 to mix the liquid without introducing air into the liquid from blower 14. The clutch may be included in aerator 10 along with throttle valve 28, or the clutch may be included alone. Any type of clutch known in the art may be used.

Figure 3C:
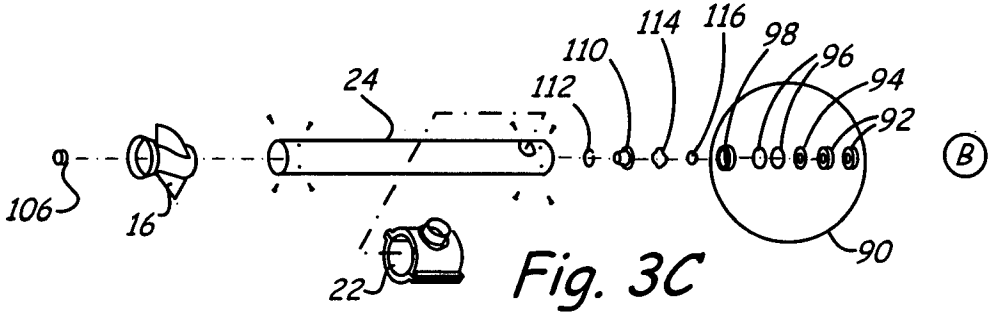
FIG. 3C is an exploded perspective view of a portion of the aerator of FIG. 1 including a propeller and a draft tube.
Figure 3B:
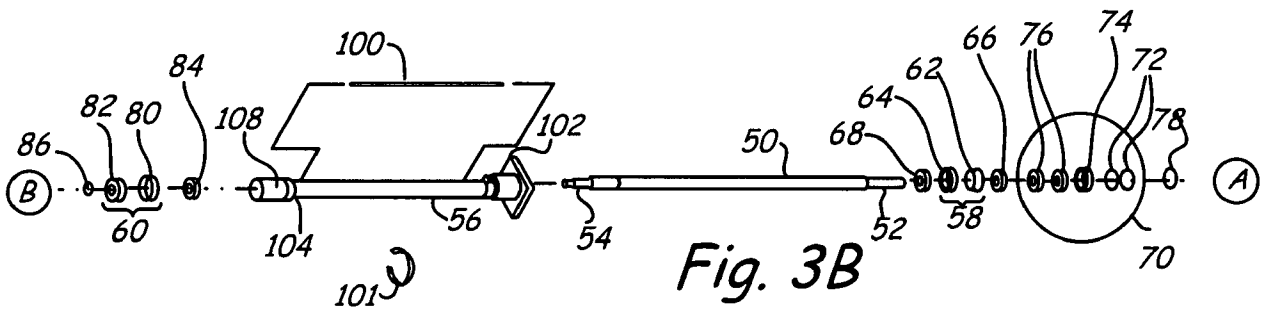
FIG. 3B is an exploded perspective view of a portion of the aerator of FIG. 1 including a propeller shaft.
Figure 3A:
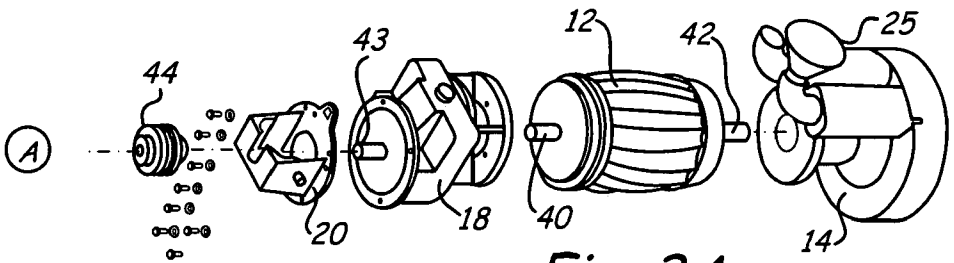
FIG. 3A is an exploded perspective view of a portion of the aerator of FIG. 1 near a motor.

FIG. 3A–3C show partial exploded perspective views of aerator 10 of FIGS. 1 and 2 along a common axis. The common axis runs from reference A in FIG. 3A to reference A in FIG. 3B and then runs from reference B in FIG. 3B to reference B in FIG. 3C. Discharge pipe 26 and associated components are omitted from FIGS. 3A–3C for ease of viewing. In addition, the orientation of air intake 25 on blower 14 is reversed from the orientation shown in FIGS. 1–2.

As shown in FIG. 3A, motor 12 has a pair of motor drive shafts 40 and 42 extending from opposite ends. Drive shaft 40 connects to transmission 18 and drive shaft 42 connects to blower 14. In other embodiments, drive shaft 42 connects to transmission 18 and drive shaft 40 connects to blower 14. A flexible coupling 44 housed within motor mount 20 connects a shaft 43 of transmission 18 to a propeller shaft 50 shown in FIG. 3B. The flexible coupling takes up parallel or angular misalignment between the propeller shaft and the motor drive shaft and/or the transmission shaft. A coupling of the Woods type, Lovejoy type, or any other type known in the art may be used. In addition, any other connection means known in the art may be used to connect transmission 18 and propeller shaft 50. Likewise, any connection means known in the art may be used to connect drive shaft 42 and blower 14.

As shown in FIG. 3B, propeller shaft 50 has an upper end 52 and a lower end 54. Upper end 52 connects to coupling 44 while lower end 54 connects to propeller 16. In one embodiment, the propeller shaft is a solid, one-piece shaft formed from stainless steel or any other suitable material and has a diameter of at least about one inch. To achieve maximum aeration, the propeller shaft should be long enough to submerge the propeller beneath the liquid surface to prevent splashing.

Propeller shaft 50 extends through a bearing support tube 56 which mounts to motor mount 20. An upper bearing 58 and a lower bearing 60 are housed within bearing support tube 56 and align propeller shaft 50 to take up thrust loads from propeller 16. Upper bearing 58 supports propeller shaft 50 near upper end 52 and lower bearing 60 supports propeller shaft 50 near lower end 54 to provide maximum stability to propeller shaft 58. In alternate embodiments, the bearings may be located along propeller shaft 50 in any multiplicity and at any location.

Upper bearing 58 includes a bearing cone 62 and a bearing cup 64, which are flanked by a lug nut 66 and a seal 68. An upper seal 70 abutting lug nut 66 protects upper bearing 58 from liquid penetration due to splashing, submergence, or any other action that may cause foreign liquid to enter bearing 58. Upper end seal 70 includes a pair of O-ring seals 72, a seal module 74, and a pair of seals 76. A retaining ring 78 helps retain upper seal 70 and upper bearing 58 on end 52 of propeller shaft 50.

Similarly, lower bearing 60 includes a bearing cup 80 and a bearing cone 82, which are flanked by a seal 84 and an external retaining ring 86. As shown in FIG. 3C, a lower end seal 90 protects bearing 60 by forming a seal that helps prevent foreign liquid from penetrating bearing 60. Lower end seal 90 includes a pair of seals 92, a seal cover 94, a pair of O-ring seals 96, and a seal module 98. Both upper end seal 70 and lower end seal 90 are removable so the bearings can be inspected and seals or seal components can be replaced.

As shown in FIG. 3B, a grease tube 100 is fastened to the outside of bearing support 56 by a fastener 101. Grease tube 100 extends from a grease port 102 formed in bearing support 56 near the end abutting motor mount 20 to a grease port 104 formed in bearing support 56 near the end abutting propeller 16. When propeller 16 is submerged in a liquid, grease port 102 is preferably located above the liquid surface to provide a pathway for supplying lubricant to lower bearing 60 without introducing foreign liquid.

Propeller 16 has a hole to receive lower end 54 of propeller shaft 50. Propeller 16 is retained on propeller shaft 50 by a lug nut 106 and a set screw 108 (shown in FIG. 3B). An example of a suitable propeller includes a stainless steel cast, non-fouling, high efficiency, low vortexing, hollow hub propeller that minimizes aerodynamic drag and interference. Any other propeller known in the art may also be used.

In one embodiment, at least a portion of propeller 16 fits inside draft tube 24 so that under normal operating conditions, when propeller 16 is submerged beneath the surface of a liquid, a hydrodynamic seal is formed between propeller 16 and draft tube 24. This seal causes air from blower 14 to exit through the hub formed in propeller 16 and not through any space existing between propeller 16 and draft tube 24. In other embodiments, air may exit through both propeller 16 itself and the space existing between propeller 16 and draft tube 24, or the air may exit through the space alone.

A splash guard cone 110 is provided on the propeller side of lower end seal 60 to protect lower end seal 60 against foreign materials and liquids. Splash guard cone 110 may be fabricated from stainless steel or any other suitable material. A retaining ring 112, a splash guard cone 114, and a wave spring 116 are associated with splash guard cone 110.

When motor 12 of the present invention is engaged, blower 14 and propeller 16 turn simultaneously. Transmission 18 enables blower 14 and propeller 16 to operate at different speeds. The ability to operate blower 14 and propeller 16 at different speeds is a key feature of the present invention because it allows blower 14 and propeller 16 to operate more efficiently and provides better mixing of the liquid and/or the air. In some embodiments of the present invention, transmission 18 is geared so that blower 14 rotates at a speed of rotation (measured in rotations per minute, "rpm") that is at least about twice as great as the speed of rotation of propeller 16. In other embodiments, transmission 18 is geared so that blower 14 rotates at a speed of rotation that is at least about three times as great as the speed of rotation of propeller 16. Particularly suitable rotation speeds for propeller range 16 from about 400 rpm to about 1,000 rpm, while particularly suitable rotation speeds for blower 14 range from greater than about 3,600 rpm.

For transmission 18 to enable blower 14 and propeller 16 to operate at different speeds, it must be geared to either increase the rate of rotation of propeller 16 or blower 14 relative to the motor speed or decrease the rate of rotation of propeller 16 or blower 14 relative to the motor speed. As shown in FIGS. 1–3, transmission 18 functions as a gear reducer and enables propeller 16 to turn slower than motor 12 and blower 14, which turn at the same speed. Thus, for example, when transmission 18 has a gear ratio of 4:1 and motor 12 operates at 3,600 rpm, propeller 16 and blower 14 have rotation speeds of 900 rpm and 3,600 rpm, respectively.

Transmission 18 may also be connected to the drive shaft of motor 12 closest to blower 14 (i.e. drive shaft 42). In such a configuration (not shown), motor 12 may be operated at a lower rpm and transmission 18 may be used to accelerate the rotation speed of blower 14. Thus, for example, if transmission 18 in this alternate embodiment has a gear ratio of 1:4 and motor 12 operates at 900 rpm, propeller 16 and blower 14 have rotation speeds of 900 rpm 3,600 rpm, respectively.

Figure 4:
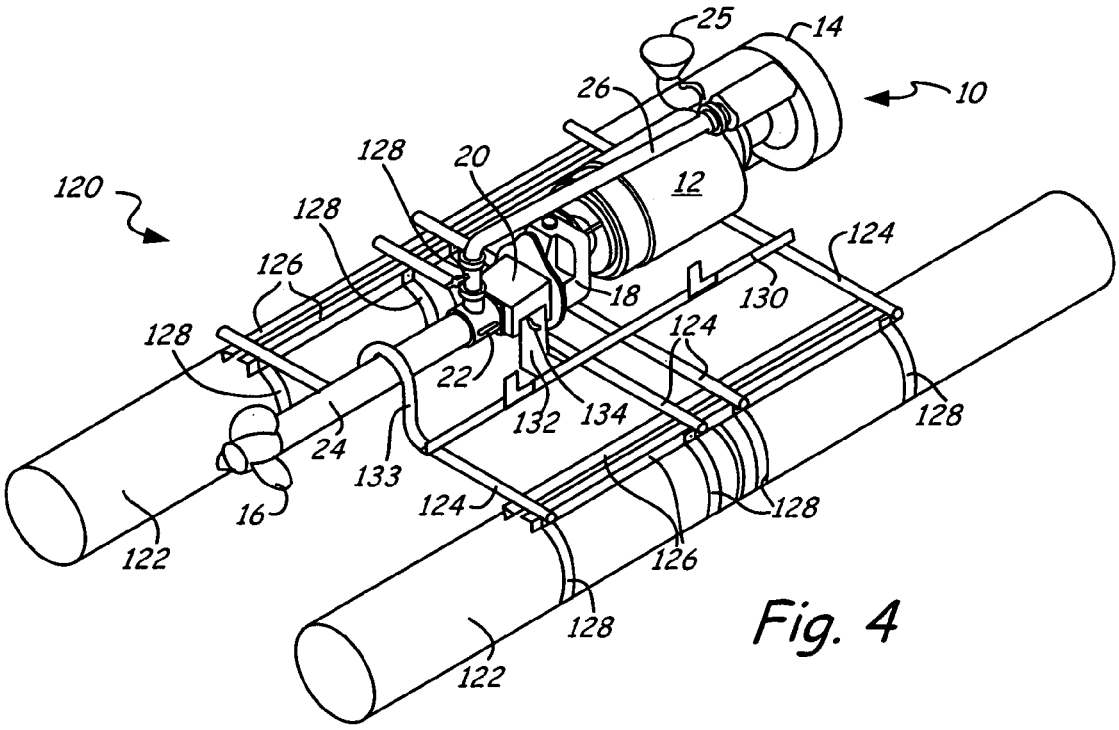
FIG. 4 is a perspective view of the aerator of FIG. 1 mounted to a support system.

FIG. 4 shows a perspective view of aerator 10 mounted on a support system 120. Support system 120 is a flotation-type system wherein a pair of floats 122 float on the surface of the liquid being treated. Floats 122 function as vertical supports, providing support vertically above the surface of the liquid. Horizontal supports 124 are connected to floats 122 by mounting bars 126, which are secured to floats 122 by mounting straps 128. Any number of horizontal support bars 124 may be used to space floats 122 and support aerator 10 at a desired horizontal location between floats 122. Braces 130 are connected to horizontal supports 124 to brace horizontal supports 124 and provide a structure for attaching mounting hinges 132. The horizontal support(s) located on the propeller side of mounting hinges 132 may have a recess or curved portion 133 to accommodate aerator 10 in a horizontal position and provide support to aerator 10.

Mounting hinges 132 (one shown in FIG. 4) attach to motor mount 20 of aerator 10 and allow aerator 10 to pivot from a horizontal position to a vertical position. Mounting hinges 132 may have a semi-circular slot 134 to receive pins (not shown) extending from opposite sides of motor mount 20. The angle of operation of aerator 10 is variable and mounting hinges 132 may be indexed to display the angle of operation. The aerator may also be pivotally or slidably attached to the support system using any attachment means known in the art.

In one embodiment, motor mount 20 is designed to allow for removal of motor 12 or an aerator section for service without dismantling the entire aerator from the mounting system.

Any type of support system known in the art may be used to support the aerator of the present invention, including non-flotation type support systems. For example, the aerator may be coupled to a stationary structure such as a wall or other stationary member. In addition, any attachment means known in the art may be used to attach the aerator to the support system, including any means for pivoting the aerator from a horizontal position so the propeller is submerged beneath a liquid surface.

As described above, the aerator of the present invention enables a blower and a propellor to be powered by the same motor. The blower provides an increased ability to supply air to the propeller and aerate liquid. A transmission is included in the aerator so the blower and the propellor can operate at different speeds to provide increased operational efficiency. An air flow valve is included in the aerator so air flow from the blower to the propeller can be regulated and even shut off. As such, the aerator of the present invention may be used both as an aerator or as a mixer.

Although the present invention has been described with reference to preferred embodiments, workers skilled in the art will recognize that changes may be made in form and detail without departing from the spirit and scope of the invention.

What is claimed is:

1. An aerator for inducing air flow below a surface of a liquid, the aerator comprising:

a motor having a first drive shaft and a second drive shaft;

a propeller operably connected to the first drive shaft;

a blower operably connected to the second drive shaft; and an air flow path having an inlet and an outlet, the inlet connected to the blower and the outlet located near the propeller;

wherein the blower and the propeller rotate at different speeds.

2. The aerator of claim 1, wherein a clutch operably connects the blower and the second drive shaft of the motor, the clutch enabling the motor to rotate the propeller without rotating the blower.

3. The aerator of claim 1 further comprising:

a transmission operably connected to the motor.

4. The aerator of claim 3, wherein the transmission operably connects the second drive shaft to the blower.

5. The aerator of claim 3, wherein the transmission operably connects the first drive shaft to the propeller.

6. The aerator of claim 3, wherein the transmission enables the blower to rotate at least twice as fast as the propeller.

7. The aerator of claim 3, wherein the transmission enables the blower to rotate at least three times as fast as the propeller.

8. The aerator of claim 1, wherein a discharge pipe connects to the blower to form at least a portion of the air flow path.

9. The aerator of claim 1, wherein at least a portion of the air flow path comprises an elongated tubular housing, a propeller shaft extending through the tabular housing, wherein the propeller shaft connects at a first end to the first motor drive shaft and at a second end to the propeller.

10. The aerator of claim 1 further comprising:

a valve to regulate air flow along the air flow path.

11. An aerator for treating a liquid, the aerator comprising:

a motor having a first drive shaft and a second drive shaft;

a propeller connected to the first drive shaft; and a blower connected to the second drive shaft, wherein the blower is in communication with an air flow path having an outlet located near the propeller;

wherein the propeller and the blower rotate at different speeds.

12. The aerator of claim 11, wherein the blower has a rate of rotation at least twice as fast as the propeller.

13. The aerator of claim 11, wherein the blower has a rate of rotation at least three times as fast as the propeller.

14. The aerator of claim 11 further comprising:

a transmission operably connecting the second motor drive shaft and the blower.

15. The aerator of claim 11 further comprising:

a transmission operably connecting the first motor drive shaft and the propeller.

16. The aerator of claim 11 further comprising:

a clutch operably connecting the second motor drive shaft and the blower, the clutch enabling the motor to rotate the propeller without rotating the blower.

17. The aerator of claim 11 further comprising:

a valve to regulate air flow along the air flow path.

18. A method for treating a liquid, the method comprising:

rotating, at a first rate, a submerged propeller powered by a first drive shaft of a motor; and delivering air to a location near the propeller, wherein at least a portion of the air is supplied by a blower, powered by a second drive shaft of the motor, that rotates at a second, higher rate of rotation.

19. The method of claim 18 further comprising:

regulating the amount of air supplied by the blower.

20. The method of claim 18, wherein the second rate of rotation is at least twice the first rate.

21. The method of claim 18, wherein the second rate of rotation is at least three times the first rate.

22. The method of claim 18, wherein the air is delivered through a hub in the propeller and mixed with the liquid.

* * * * *

UNITED STATES PATENT AND TRADEMARK OFFICE

CERTIFICATE OF CORRECTION

PATENT NO. : 7,048,260 B2
APPLICATION NO. : 10/844593
DATED : May 23, 2006
INVENTOR(S) : Peter S. Gross et al.

It is certified that error appears in the above-identified patent and that said Letters Patent is hereby corrected as shown below:

Column 6, Line 18, delete “tabular”, insert --tubular--

Signed and Sealed this

Nineteenth Day of December, 2006

JON W. DUDAS
*Director of the United States Patent and Trademark Office*